US005235825A

United States Patent [19]

Turini

[11] Patent Number: 5,235,825

[45] Date of Patent: Aug. 17, 1993

[54] PNEUMATIC SUCTION APPARATUS FOR TENSIONING, REVERSING AND CONVEYING AWAY A TUBULAR KNITTED ARTICLE

[76] Inventor: Francesco Turini, Via 1° Maggio No. 2, 50050 Stabbia, Cerreto Guidi, Firenze, Italy

[21] Appl. No.: 921,522

[22] Filed: Jul. 29, 1992

[30] Foreign Application Priority Data

Jul. 31, 1991 [IT] Italy ..... FI/91/A195

[51] Int. Cl.[5] ..... D04B 15/88

[52] U.S. Cl. ..... 66/149 S

[58] Field of Search ..... 66/149 S, 149 R, 147

[56] References Cited

U.S. PATENT DOCUMENTS

| | | | |
|---|---|---|---|
| 3,267,698 | 8/1966 | Poteat | 66/149 S |
| 4,339,932 | 7/1982 | Lomati | 66/149 S X |
| 5,052,196 | 10/1991 | Turini | 66/149 S |

FOREIGN PATENT DOCUMENTS

| | | | |
|---|---|---|---|
| 2126388 | 5/1971 | Fed. Rep. of Germany | 66/149 S |
| 2818796 | 11/1978 | Fed. Rep. of Germany | 66/149 S |
| 2067889 | 7/1971 | France | 66/149 S |
| 1055701 | 1/1967 | United Kingdom | 66/149 S |
| 1314977 | 4/1973 | United Kingdom | 66/149 S |
| 2133049 | 7/1984 | United Kingdom | 66/149 S |

*Primary Examiner*—Clifford D. Crowder
*Assistant Examiner*—John J. Calvert
*Attorney, Agent, or Firm*—McGlew and Tuttle

[57] ABSTRACT

A duct (12) movable axially within a tubular wall (1) is provided so as to form with the latter a cavity (I) with grill (14) and an expansion piece (7) shaped so as to cooperate with the upper edge of the duct (12) when the latter is raised so as to close it off and when the latter is lowered so as to form an annular space. A body (18) with holes (20) for entry of the air into the cavity (I) is provided at the end of the tubular wall (1). The duct (12) is movable through a central hole (18A) of the body (18) and has a collar (24) which closes off the holes (20) when the duct (12) is raised, and has holes (26) which, when the duct (12) is raised, are located above the body (18) and, when the duct (12Is lowered, are closed off by the wall of the hole (18A). The suction current is created in the duct (12) during the two phases of tensioning and reversing.

9 Claims, 3 Drawing Sheets 1A
3
205
207
1
I
12
14
22
66A
66
f62
62
53
55
51
f57
57
64A
12B
12A
64

PNEUMATIC SUCTION APPARATUS FOR TENSIONING, REVERSING AND CONVEYING AWAY A TUBULAR KNITTED ARTICLE

SUMMARY AND OBJECTS OF THE INVENTION

The invention relates to pneumatic apparatuses for tensioning and reversing (i.e. turning inwards) a tubular manufactured article formed by the circular knitting machine (for stockings, socks, etc.) with which the apparatus is combined, and also serving to convey away the manufactured article by means of a suction air current. Said apparatuses comprise a duct movable axially within a tubular wall so as to form with the latter a cavity with an intercepting grill; this apparatus comprises an expansion piece shaped so as to cooperate with the upper edge of said movable duct when the latter is raised so as to close it off and when the latter is lowered so as to form an annular space; during a first phase, the apparatus is set so as to effect suction through the cavity for the purpose of tensioning and, during the second phase, so as to effect suction inside the duct via the annular space for the purpose of reversing and conveying away.

In order to simplify the apparatus, according to the invention, a body with holes for entry of the air into the cavity and with a central hole for the movable duct is provided at the end of the tubular wall; the movable duct passes centrally through said body, has a collar or other equivalent member designed to close off said holes when the duct is raised, and has moreover a zone provided with holes which, when the duct is raised, are located above said body and, when the duct is lowered, are closed off by the wall of the hole of the body inside which said duct slides; a suction current is created in said duct during the tensioning phase and also during the reversing and conveying away phase.

In a possible embodiment, said collar or equivalent member closes off the holes by moving towards the bottom surface of the body in which said holes are formed, extending parallel to the central hole.

The actuator which controls axial displacement of the duct may be attached to said collar or equivalent member.

When the expansion piece is not supported from above, in particular by the plate, advantageously—so as to obtain an unreversed manufactured article —an additional suction duct for conveying away said article may be provided more or less correspondingly with said annular space between the expansion piece and the upper edge of the movable duct; two gate valves are provided respectively on the conveying duct connected to said internal duct and on said additional conveying duct, said gate valves being operated such that one is closed and the other open, depending on whether the manufactured article is to be conveyed away in the reversed or unreversed condition. For tensioning, the gate valve of the movable duct is kept open and, for conveying away, said gate valve is kept open if the manufactured article is to be reversed; said gate valve is closed prior to lowering of the movable duct and the gate valve of said additional duct is opened if the manufactured article is to be conveyed away without being reversed.

BRIEF DESCRIPTION OF THE DRAWINGS

The invention will be better understood with reference to the description and accompanying drawing which shows a practical non-limiting example of said invention. In the drawing.

DETAILED DESCRIPTION OF THE PREFERRED EMBODIMENTS

Figure 1:
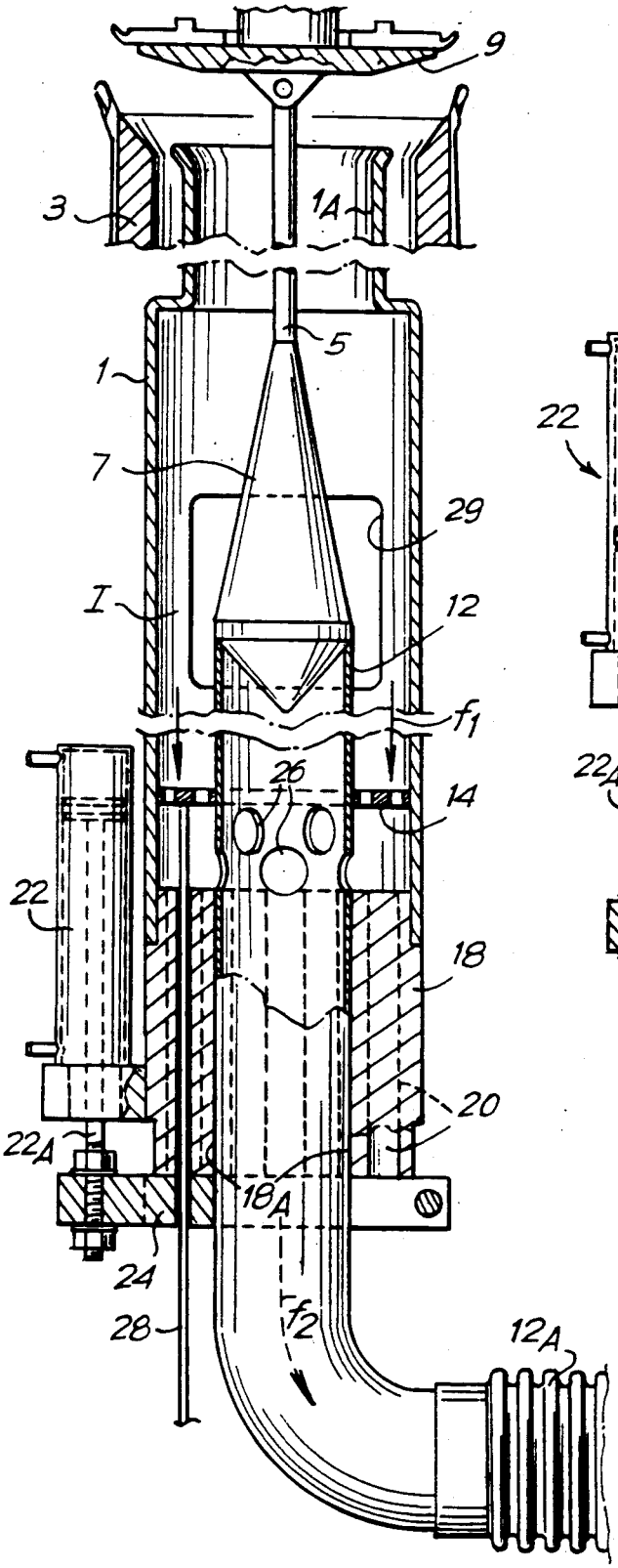
FIGS. 1 and 2 show a first solution of the invention, in vertical section and in two operating conditions.

According to that illustrated in the accompanying drawing, 1, IA denote a tubular wall which is coaxial with the needle cylinder 3 and inside which there extends a rod 5 carrying at the bottom an expansion piece 7 shaped with a receiving surface, towards the top and in the manner of a cone towards the bottom, with an arrangement entirely similar to that envisaged in prior patents of the same holder, such as Italian Patents Nos. 1,224,233, 1,222,225 and 1,22,2,266 and Patent Application No. BE 0,329,625 and U.S. Pat. No. 5,052,196 issued Oct. 1, 1991 Ser. No. 309,771. The thinnest part 1A penetrates into the cylinder 3. The rod 5 may be anchored to the hook plate indicated generically by 9; the articulation between the rod 5 and the hook plate 9 is sufficient to allow raising of the plate about a lateral hinging point with a skew axis and lying in a plane perpendicular to the axis of the needle cylinder and of the rod 5. With the expansion piece 7 there cooperates a duct 12 located within the tubular wall 1 and capable of performing axial (and vertical) displacements so as to make contact, with its upper edge, with the expansion piece 7 or move away from said expansion piece 7 in a downwards direction respectively. In the operating condition of the tube 12 shown in FIG. 1, with said tube 12 and expansion piece 7 is completed a cavity I surrounding the tube 12 and the expansion piece 7 and defined between these members and the tubular wall 1; the cavity I is used for drawing in the tubular manufactured article which is formed with the needles of the cylinder 3 and which is tensioned by an air current sucked in the direction of the arrow Fl along the cavity I and through a grill 14 which intercepts the cavity I and retains the manufactured article which reaches said grill, thus preventing the manufactured article from penetrating beyond the grill 14 itself. When the completed manufactured article is released by the cylinder needles, it is retained above the grill 14 and must be able to be reversed, i.e. turned inwards. For this purpose, the duct 12 is lowered for example into the operating condition shown in FIG. 2 and a different suction current is created within the duct 12, in the direction of the arrow F2; this current sucks air into the interspace which is formed, upon lowering of the duct 12, between the upper edge of the latter and the expansion piece 7, as indicated by the arrows F3, the air being sucked once again but in the opposite direction through the grill 14. The manufactured article is thus turned inwards from the cavity I inside the duct 12, where it is drawn along in the direction of the arrow F2 and conveyed away along a flexible section 12A of said duct 12 in order to reach other components of the tensioning and reversing apparatus known per se.

The invention concerns a simplified solution for carrying out the functions of the various members and accomplishing movement thereof. In accordance with the illustrations of FIGS. 1 and 2, at the bottom end of the tubular wall 1 is attached a cylindrical body 18 which has a series of longitudinal through-holes 20 surrounding a central hole 18A of the body 18, through which central hole 18A the duct 12 passes and is able to slide. The duct 12 may be operated in its vertical displacements—described above—by a cylinder/piston actuator 22, the cylinder of which is attached to the body 18 while the rod 22A of the piston is attached to a collar element 24 which surrounds the duct 12 and may be attached to it by clamping or welding respectively or by some other suitable method, in such a way that, by controlling the actuator 22, the element 18 may be moved and the duct 12 is able to slide inside the central hole 18A of the body 18. When the duct 12 is raised into the position shown in FIG. 1 and hence brought into contact with the expansion piece 7, the collar element 24 comes up against the bottom surface of the body 18 and is thus able to close off the holes 20, while these holes 20 remain open when the actuator 22 lowers the collar element 24 and hence the duct 12, moving the latter away from the expansion piece 7 into the operating condition shown in FIG. 2, in order to reverse and convey away the manufactured article.

Figure 2:
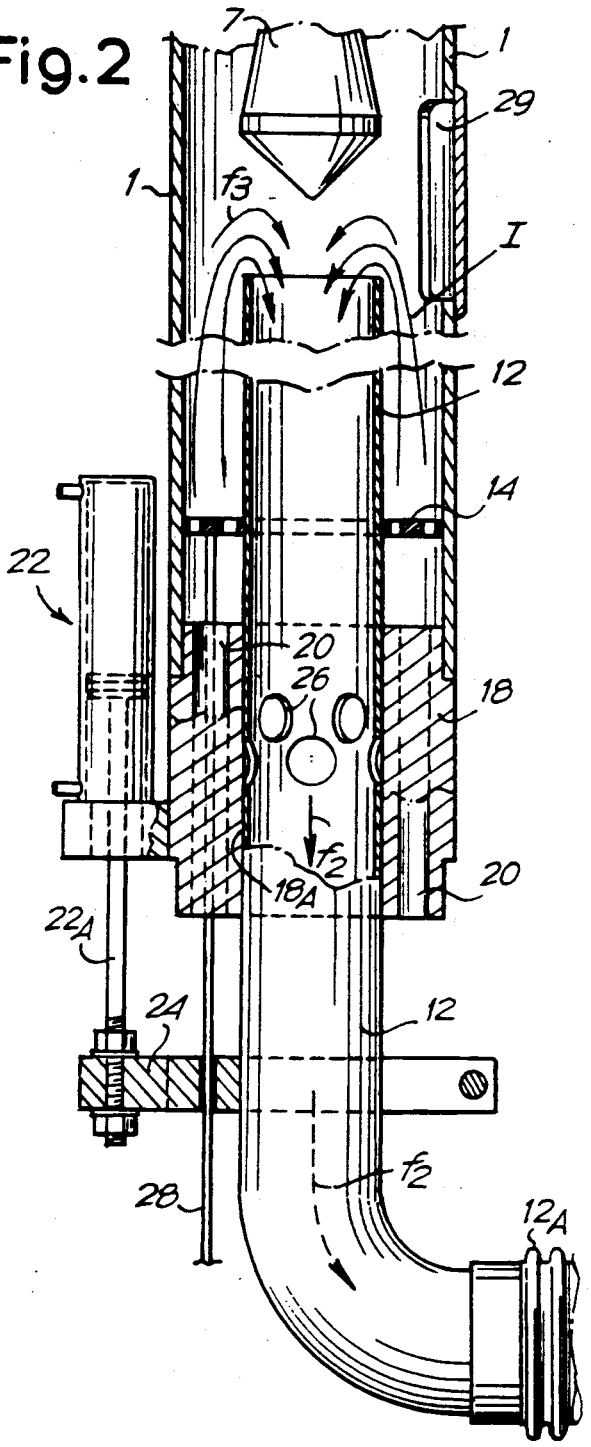

The duct 12 has a series of holes 26 in an annular zone such that, when the duct 12 is raised into the operating condition shown in FIG. 1, the holes 26 are uncovered above the cylindrical body 18 and the holes 20 are closed off, while in the lowered, operating condition of the duct 12 (see FIG. 2) the holes 26 remain closed off by the wall of the central through-hole 18A of said body 18, and the perimetral holes 20 are open.

The position of the grill 14 may be adjusted by means of at least one rod 28 whch passes through a special through-seat in the body 18 and may be manually adjusted so as to adapt the grill 14 suitably, according to the operations being performed; the grill 14 in any case is located above the position assumed by the holes 26 in the raised operating condition of the duct 12 in which the upper edge of this duct rests against the expansion piece 7. The rod 28 can be operated so as to raise the grill 14 up to the level of an inspection window 29 in the region of the upper end of the tube 12 and the expansion piece 7; thus, via the window 29—in addition to checking the operation—it is also possible to carry out periodic cleaning of the grill 14. The rod 28 may have a flexible sheath so as to allow operations to be performed without being obstructed by the ground.

With the single actuator 22, therefore, it is possible to accomplish the functions which are required for the operations of tensioning of the manufactured article being formed and of reversing, i.e. turning inwards, of said manufactured article and conveying it away along the duct 12, 12A. In fact, by raising, with the actuator 22, the collar element 24 and the duct 12, the holes 26 are uncovered above the body 18 and the holes 20 are closed off by the collar element 24. Suction through the duct 12, 12A causes suction in the direction of the arrow F1 in the cavity I so as to tension the manufactured article being formed, the air current being created through the cavity I, the grill 14, the holes 26 and the duct 12, 12A, said duct resting against the expansion piece 7. When the actuator 22 lowers the duct 12, 12A, the upper edge of the duct 12 is conveyed away from the expansion piece 7, the holes 26 (arranged on the inside of the central through-hole 18A of the body 18) are closed off, while the holes 20 are uncovered as a result of the collar, element 24 being conveyed away from the bottom end thereof and hence from the body 18; under these conditions, suction, still in the direction F2 inside the duct 12, 12A, causes air to be drawn in from outside via the ring of holes 20 and through the grill 14 upwards in the direction of the arrows F3, again owing to the suction effect in the direction F2. Suitable measures may be taken in order optionally to limit the amount of the air flow which could be drawn in by the current in the direction F2 inside the cylindrical wall 1 and around the expansion piece 7, i.e. from the needle cylinder.

As a result of the arrangement described, which is thus simpler than previous solutions, not only can costs be reduced and controls made simpler, but the overall dimensions may be reduced, with all the advantages associated with the possibility of arranging the apparatus on various types of machines, without the need for any particular limitation of the dimensions of the apparatus.

Figure 3:
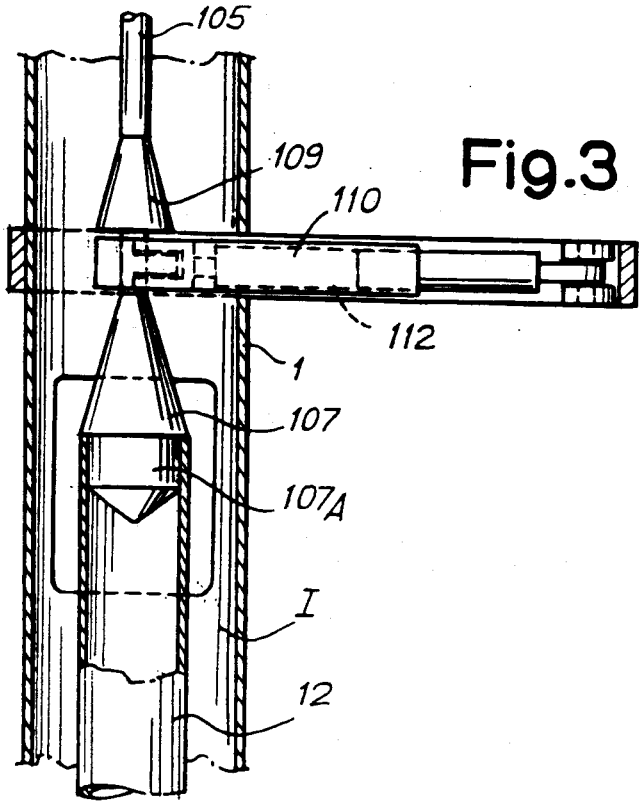
FIGS. 3, 3A and 4,5 show in schematic form two variations of embodiment, in vertical and horizontal section.
Figure 3A:
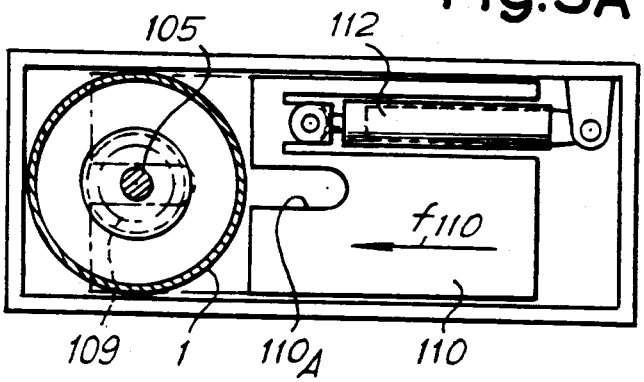

FIG. 3 shows in diagrammatic form a possible solution for supporting the expansion piece 107, equivalent to the expansion piece 7, when this expansion piece cannot be connected, via a rod 5, to a plate 9; in this case, since there is a rod 105 which nevertheless serves as a guide for the regular formation of the manufactured article around it and as far as the cavity I, it is possible to provide a smaller step-type expansion piece 109 located above the expansion piece 107 and a guillotine member 110 which can be made to slide in the direction of the arrow F110 from a disengaged position outside the tubular wall 1 to a position within said tubular wall 1 in order to support the assembly 107, 109, 105 with a slot-shaped seat 110A formed in the guillotine member 110 for attaching the rod 105 underneath the step-type expansion piece 109, when the assembly 107, 109 and 105 can no longer be supported by the duct 12 which has the function of supporting it under the conditions shown in FIG. 1, i.e. when the manufactured article is formed and is sucked in the direction of F1 into the cavity I; with lowering of the duct 112 in order to create the passage between the expansion piece 107 and the upper edge of said duct 12 in the direction of the arrows F3, the assembly 107, 109 and 105 would not be supported, since it is not connected to the plate, either because such a connection is not possible or owing to the absence of such a plate. In this case, said guillotine member 110, which can be controlled by a suitable cylinder/piston actuator 112 or the like, is provided precisely in order to activate the supporting action of the member 110 for the period during which the duct 12 must be lowered and until the time when the duct 112, being raised, again supports the assembly 107, 109, 105, engaging around the end portion 107A, which is specially shaped at the bottom, of the expansion piece 107 in order to effect said supporting action.

Figure 5:
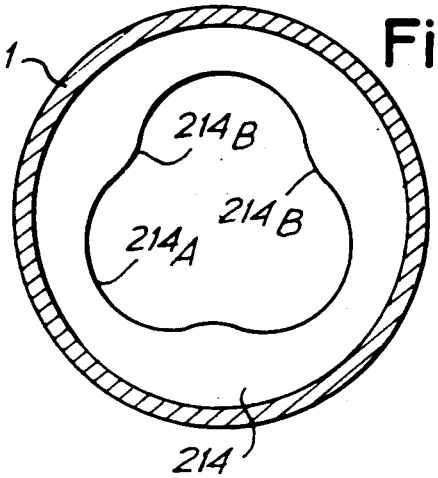
Figure 4:
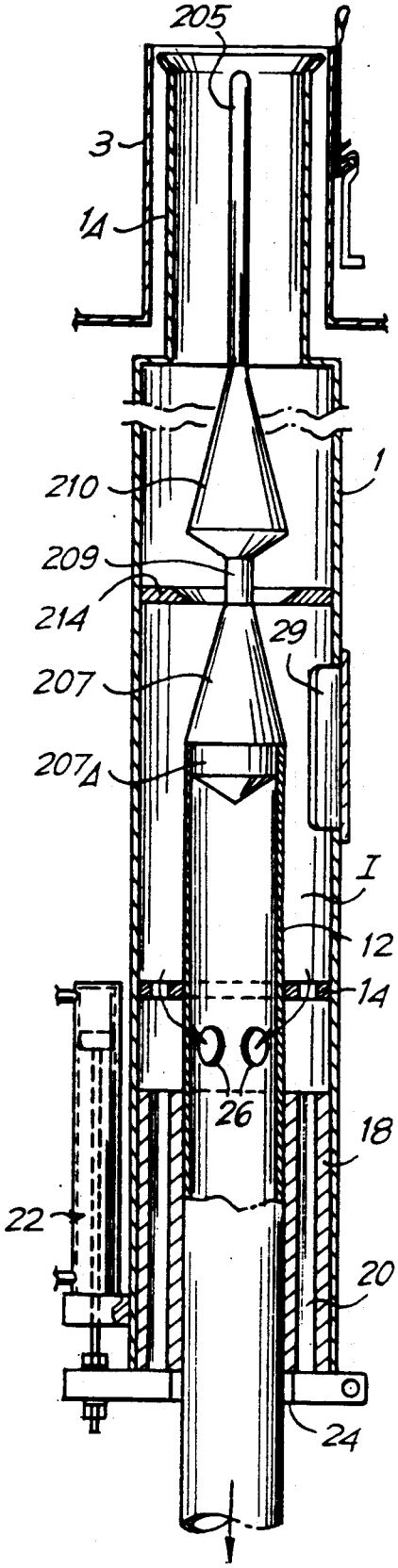

In the further variant of FIGS. 4 and 5, an assembly is provided within the tubular wall 1, said assembly comprising an expansion piece 207 equivalent to the expansion piece 7 or 107 and capable, as a result of its shape, of being supported by the upper edge of the duct 12; this assembly within the wall 10 comprises, in addition to the expansion piece 207, a constriction 209 and a second expansion piece 210 shaped with a double receiving surface and a rod 205 similar to the rod 105. The wall 1 supports in this case a collar 214 (see also FIG. 5)

with a wide internal aperture 214A having slight internal projections 214B, of which there are three in number for example. This collar with its projections 214B cooperates with the expansion piece 210, supporting it when the duct 12 is lowered for the functions already described, whereas when the duct 12 is raised, it engages over the bottom shaped portion 207A of the expansion piece 207 and raises the assembly 207, 209, 210, 205 from the collar 214, thus ensuring a sufficiently wide annular passage between the constriction 209 and the collar 214 so as to allow pneumatic drawing-in and tensioning of the manufactured article through this annular aperture as far as the cavity I for the already ,mentioned functions of tensioning and receiving the manufactured article up to a point above the grill 14. As regards the remainder, the arrangement is the same as that already described.

Figure 6:
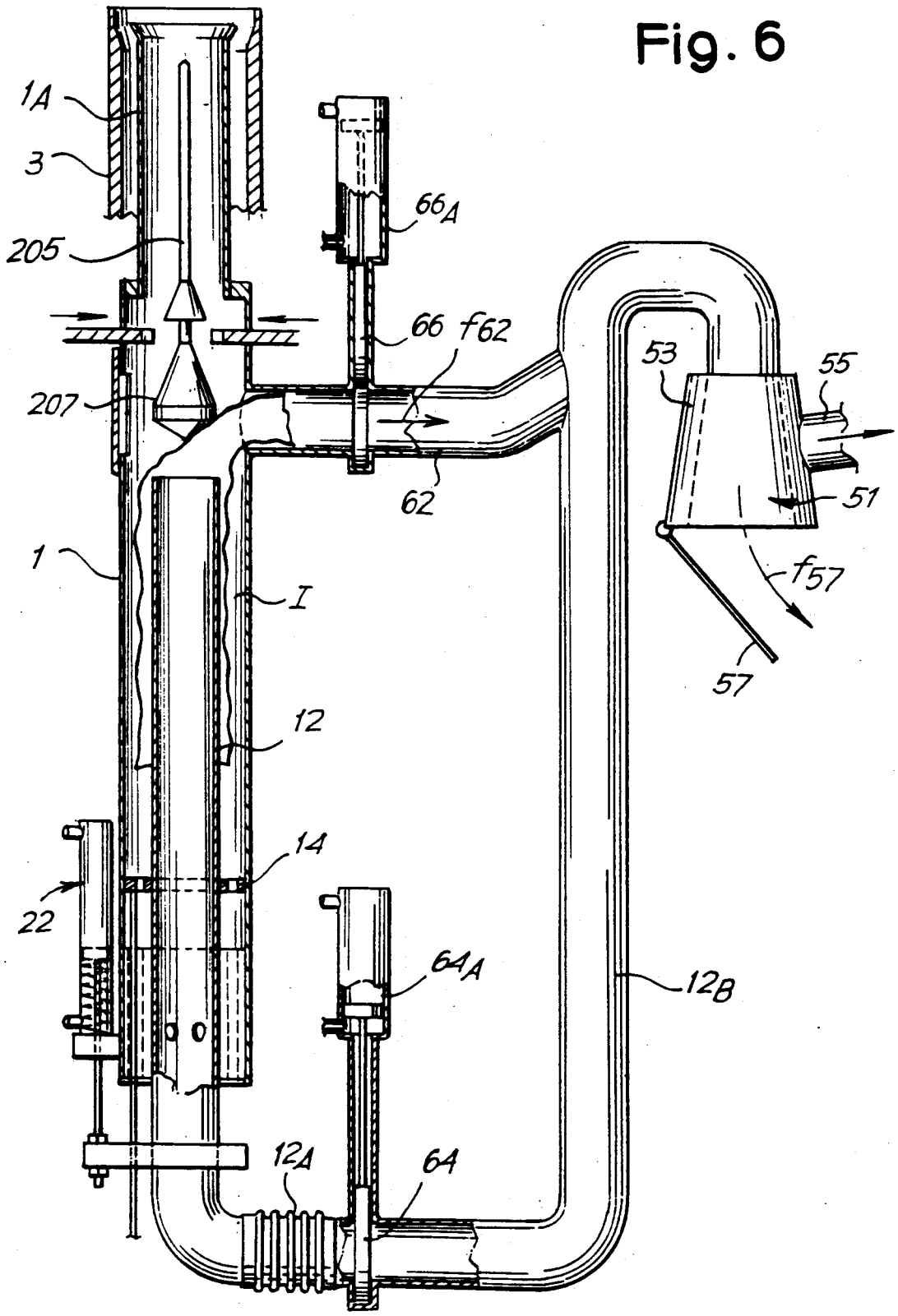
FIG. 6 shows a solution for the alternative embodiment which avoids inward turning.

FIG. 6 shows a solution of the tensioning apparatus by means of which it is possible either to convey away the manufactured article after it has been reversed from the cavity I into the duct 12 or to convey away the manufactured article without it being reversed, which is sometimes required in order to be able to carry out periodic checks or in cases where manufactured articles are required which are not reversed with respect to the conditions in which they are woven as tubular articles by the needle cylinder 3.

In embodiments of the apparatus where the expansion piece such as 7 is suspended with the rod such as 5 suspended from the plate, it is possible, when required or periodically, to remove a sample of the manufactured article which has not been reversed i.e. not turned inwards. For this purpose, it is sufficient to lower the duct 12 during the formation of the manufactured article and effect suction from the duct 12 instead of from the cavity I, via suitable commands different from those of the normal cycle involving reversing. The manufactured article is thus inserted into the duct 12 instead of the cavity I during formation.

This function is not possible when rods and expansion pieces such as 105, 107 and 205, 207 are not suspended from a plate (or the like). In this case an arrangement such as that shown in FIG. 6 may be envisaged.

According to FIG. 6, in which the members corresponding to those of the preceding figures are indicated in the same manner and in which the arrangement of the expansion piece within the tubular wall 1 may be either of those illustrated in FIGS. 3 or 4 or the like, the duct 12, 12A is shown as extending—in the conventional manner—with a part 12B as far as a retaining container 51 defined by a grill-type lateral wall 53 via which suction is effected from an outlet 55; 57 denotes a bottom closing flap of the container 51, for unloading the manufactured article received and retained in the container 51, when, with the opening of the flap 57, said manufactured article can be made to drop in the direction of the arrow F57, so as to be suitably collected in accordance with an arrangement known per se. According to the illustration of. FIG. 6, characteristically a second duct 62 is prdvided, said duct starting from the tubular wall 1 at a height corresponding more or less to the zone where the interspace is formed between the expansion piece such as 207, 7, 107 and the upper edge of the lowered duct 12; this duct is connected to an intermediate point of the duct 12B, adjacent to the container 51. Gate valves are also provided, it being possible to control selectively said gate valves in the duct between the flexible part 12A and the rigid part 12B and in the duct 62; the first gate valve in the duct 12A, 12B is indicated by 64, and the gate valve of the duct 62 is indicated by 66; both gate valves are operated by respective actuators 64A and 66A, for example of the cylinder/piston compressed-air type. One and the same actuator is able to operate the two gate valves, one being opened and the other closed in the appropriate sequence.

With the above-described arrangement of FIG. 6, when the gate valve 66 is closed and the gate valve 64 is open, the apparatus functions in the manner already described, so that the manufactured article, tensioned and gathered in the cavity I between the duct 12 and the wall 1 above the grill 14, is drawn in—through the space between the lowered duct 12 and the expansion piece such as 207 or 107—within said duct 12 so that the manufactured article is reversed, i.e. is turned inwards, and is dispatched towards the container 51 which intercepts it and then unloads it through the opening of the flap 57. When, on the other hand, one wishes to obtain a manufactured article which is not reversed (either systematically or periodically) during tensioning of the manufactured article being formed which is to be drawn into the cavity I, the above arrangement is maintained, i.e. with the gate valve 66 closed and the gate valve 64 open. As soon as the manufactured article has separated from the needle cylinder and said article is to be conveyed away, the gate valve 64 is closed and the gate valve 66 is opened, prior to lowering of the duct 12 from the expansion piece such as 207 or 107 and supporting of the latter. Under these conditions the manufactured article gathered above the grill 14 inside the cavity I is drawn along by the air current which is formed in the direction of the arrow F62 inside the cavity I by the air obtained via the holes 20, but flowing in the direction of the duct 62, and therefore the manufactured article, instead of being turned inwards and conveyed away inside the duct 12, is conveyed away directly—without being reversed—via the duct 62 and is deposited, as before, inside the container 51, unreversed.

As a result of this arrangement, therefore, a manufactured article may be conveyed away, reversed or unreversed, in a selective or non-selective manner, with the possibility of switching over easily from one to the other, simply by operating the actuators 64A and 66A at the appropriate time, even in the case where the expansion piece is not supported by the plate.

It is understood that the drawing shows only an example of embodiment provided merely by way of a practical demonstration of the invention, it being possible for the forms and arrangements of said invention to be varied without thereby departing from the scope of the inventive idea.

I claim:

1. A pneumatic apparatus for tensioning and reversing a tubular manufactured article formed by a circular knitting machine, with which the apparatus is combined, the apparatus comprising:

a tubular wall;

a duct movable axially within said tubular wall, said duct cooperating with said tubular wall to define a cavity;

a grill positioned within said cavity adjacent said duct;

an expansion piece cooperating with an upper edge of said duct to close off said duct when said duct is in a raised position and to form an annular space with said duct when said duct is in a lowered position for effecting suction through said cavity for tensioning and to effect tension inside said duct for traversing and conveying away a tubular article manufactured;

a body positioned at an end of said tubular wall, said body including holes for entry of air into said cavity and including a central hole, said duct passing through aid central hole and passing centrally through said body;

collar means for closing off said holes of said body when said duct is raised, said duct including a zone provided with duct holes wherein said duct holes are located above said body when said duct is in said raised position and said holes are closed off by a wall of said central hole of said body when said duct is in said lowered position.

2. An apparatus according to claim 1, wherein:

said collar means includes a collar member movable to abut a bottom surface of said body to close off said holes and movable away from said body, said holes extending parallel to said central hole.

3. An apparatus according to claim 1, further comprising:

an inspection opening provided in said tubular wall for cleaning purposes, said grill being displaceable from a seated position to a location adjacent said inspection opening.

4. An apparatus according to claim 1, further comprising:

actuator means connected to said collar means for movement of said collar, said actuator means being connected to said duct for movement of said duct.

5. An apparatus according to claim 1, wherein:

said expansion piece includes support means for supporting said expansion piece, said support means including one of a rod extension and a further expansion piece and a constricted zone.

6. An apparatus according to claim 5, wherein:

said expansion piece is supported by a movable guillotine member inserted within said tubular wall.

7. An apparatus according to claim 5, wherein:

said expansion piece is supported by internal projections of an additional collar, said upper extension resting on said additional collar when said duct is in said lowered position.

8. An apparatus according to claim 7, further comprising:

an additional suction duct for conveying away the manufactured article is provided connected to said annular space between said expansion piece and an upper edge of said duct, a first gate valve being connected to said additional suction duct and a second gate valve being connected to said movable duct, each of said gate valves being operated such that one gate valve is closed and the other is opened depending on whether the manufactured article is to be conveyed away in a reversed or an unreversed condition.

9. An apparatus according to claim 8, wherein:

said gate valve of said movable duct is kept open for tensioning and said gate valve of said movable duct is kept open for conveying way if the manufactured article is to be reversed and said gate valve of said additional suction duct is closed prior to lowering of said movable duct and said gate valve of said additional duct is opened if a manufactured article is to be conveyed away without being reversed.

* * * * *